US010850537B2

(12) United States Patent
Shiohara et al.

(10) Patent No.: US 10,850,537 B2
(45) Date of Patent: Dec. 1, 2020

(54) LIQUID EJECTING APPARATUS WITH MEDIUM SUPPORTING UNIT HAVING RIBS

(71) Applicant: SEIKO EPSON CORPORATION, Tokyo (JP)

(72) Inventors: Satoru Shiohara, Shiojiri (JP); Takehito Washizawa, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/433,991

(22) Filed: Jun. 6, 2019

(65) Prior Publication Data

US 2019/0375216 A1 Dec. 12, 2019

(30) Foreign Application Priority Data

Jun. 8, 2018 (JP) ..... 2018-110207

(51) Int. Cl.
*B41J 11/00* (2006.01)
*B41J 13/02* (2006.01)

(52) U.S. Cl.
CPC ..... *B41J 11/0085* (2013.01); *B41J 13/02* (2013.01); *B41J 2202/20* (2013.01)

(58) Field of Classification Search
CPC .... B41J 11/0085; B41J 13/02; B41J 2202/20; B41J 11/06
See application file for complete search history.

(56) References Cited

U.S. PATENT DOCUMENTS

2005/0195258 A1* 9/2005 Nukui ..... B41J 11/0095 347/101
2011/0074872 A1* 3/2011 Ozaki ..... B41J 2/16523 347/30
2013/0188000 A1 7/2013 Kitagishi
2014/0132691 A1* 5/2014 Ishikawa ..... B41J 11/06 347/104

FOREIGN PATENT DOCUMENTS

JP 2013-151110 8/2013
JP 2014-094540 5/2014

* cited by examiner

*Primary Examiner* — Henok D Legesse
(74) *Attorney, Agent, or Firm* — Workman Nydegger

(57) ABSTRACT

Provided is a liquid ejecting apparatus including a liquid ejecting unit configured to eject a liquid onto a medium (sheet) being transported in a transport direction, and a medium supporting unit arranged to face the liquid ejecting unit and configured to support the sheet being transported, wherein the medium supporting unit includes, in a width direction intersecting the transport direction, a plurality of first ribs arranged in parallel with the transport direction at an upstream side of a region (print region), where the liquid ejecting unit performs ejection onto the sheet. In addition, the liquid ejecting apparatus further includes a suction mechanism, and the medium supporting unit includes, at the upstream side, a recessed portion sectioned by the first ribs, the recessed portion including a suction hole for causing a suction force by the suction mechanism to be applied onto the sheet.

5 Claims, 8 Drawing Sheets

LIQUID EJECTING APPARATUS WITH MEDIUM SUPPORTING UNIT HAVING RIBS

The present application is based on, and claims priority from JP-A-2018-110207, filed Jun. 8, 2018, the disclosure of which is hereby incorporated by reference herein in its entirety.

BACKGROUND

1. Technical Field

The disclosure relates to a liquid ejecting apparatus configured to eject a liquid onto a medium that is supported by a medium supporting unit.

2. Related Art

As a liquid ejecting apparatus configured to eject a liquid, there is known an ink jet-type printer configured to perform printing by ejecting ink onto a medium such as sheet that is transported onto a surface of a medium supporting unit. In such a printer, a phenomenon (so-called cockling) occurs in which a sheet absorbs the ejected ink to be swollen, whereby the sheet slightly bends to form waves. The occurrence of cockling causes the separation distance between the recording surface of the sheet and the nozzle forming surface of the recording head to become nonuniform to make the landing of the ink droplets unstable.

The liquid ejecting apparatus disclosed in JP-A-2013-151110 includes a transport unit configured to transport a medium, a head configured to eject ink onto the medium, and a medium supporting unit including a support surface for supporting the medium and a plurality of suction holes provided on the support surface, wherein the plurality of suction holes is provided in a region other than a typing region where the ink is ejected, on the support surface. It is stated that this configuration prevents the medium from floating to suppress an occurrence of image unevenness.

The liquid ejecting apparatus in JP-A-2013-151110 is provided with the plurality of suction holes in the region other than the typing region (print region) where ink is ejected, on the support surface of the medium supporting unit. Unfortunately, in case of a thin medium, the rigidity of the medium decreases (the buckling stress reduces), and the medium buckles at the support surface of the medium supporting unit configured to support the medium being transported. In particular, the transport resistance is the maximum at a region located upstream in the transport direction than the print region due to the transport resistance at the print region and the downstream than the print region in the transport direction, thus, buckling is liable to occur at the medium supporting unit located upstream in the transport direction than the print region.

SUMMARY

A liquid ejecting apparatus of the present application includes a liquid ejecting unit configured to eject a liquid onto a medium being transported in a transport direction, and a medium supporting unit arranged to face the liquid ejecting unit and configured to support the medium being transported, wherein the medium supporting unit includes, in a width direction intersecting the transport direction, a plurality of ribs arranged in parallel with the transport direction at an upstream side of region, where the liquid ejecting unit perform ejection onto the medium in the transport direction.

The liquid ejecting apparatus may include a suction mechanism configured to suck the medium, wherein the medium supporting unit includes, at the upstream side, a recessed portion sectioned by the first ribs, and the recessed portion includes a suction hole for causing a suction force by the suction mechanism to be applied to the medium.

The liquid ejecting apparatus may include a transporting roller configured to feed the medium to the medium supporting unit, wherein an edge portion at the upstream side of the medium supporting unit includes an eave portion overlapping the transporting roller in a plan view, and an edge portion of the eave portion includes a plurality of second ribs arranged in the width direction.

In the liquid ejecting apparatus described above, the first ribs may be arranged at equal intervals.

In the liquid ejecting apparatus described above, the first ribs may be formed integrally with or separately from the medium supporting unit.

In the liquid ejecting apparatus, a slit may be formed between the first ribs, which are adjacent to each other.

In the liquid ejecting apparatus, when the first ribs are formed separately from the medium supporting unit, the first ribs may be composed of a frame portion having a plate shape and sectioning a rectangular hole portion formed in the width direction, the frame portion being in parallel with the transport direction when arranged on the medium supporting unit.

DESCRIPTION OF EXEMPLARY EMBODIMENTS

Exemplary embodiments of the disclosure will be described below with reference to the accompanying drawings. Note that, in each of the figures below, to illustrate each of members and the like in a recognizable size, each of the members and the like is illustrated to a scale different from an actual scale.

Figure 1:
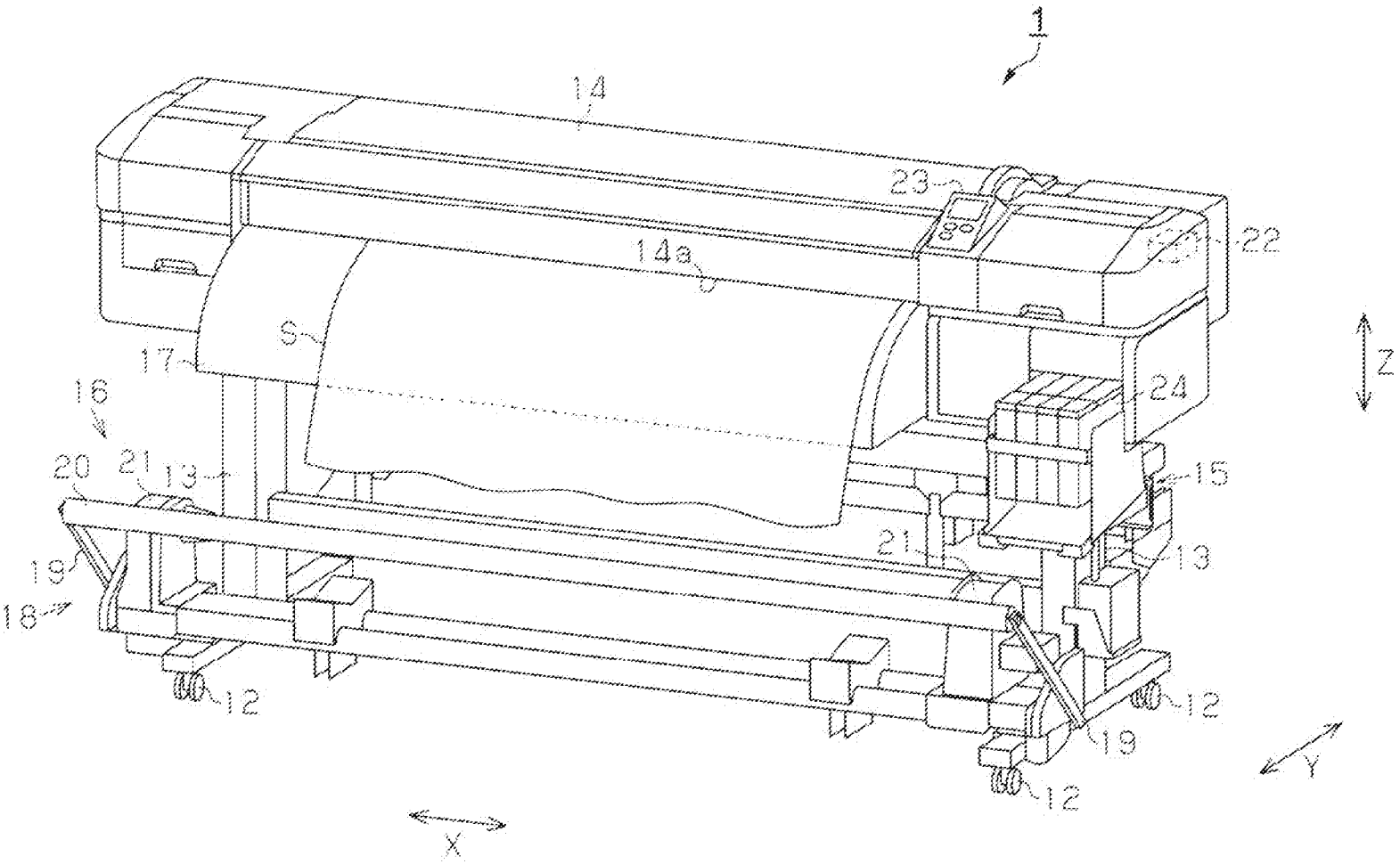
FIG. 1 is a perspective view illustrating a liquid ejecting apparatus of an exemplary embodiment.
Figure 2:
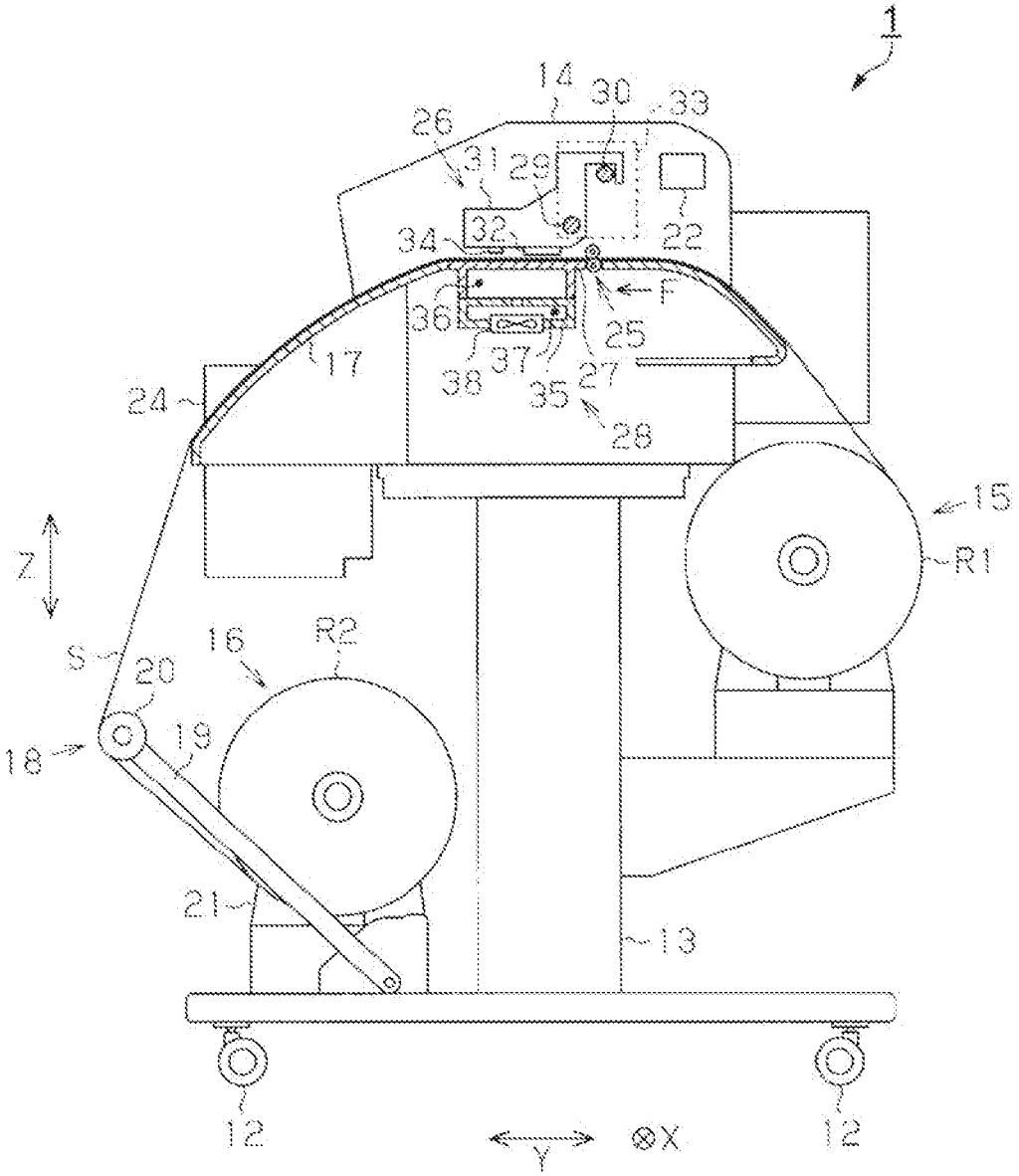
FIG. 2 is a cross-sectional view illustrating a schematic configuration of a liquid ejecting apparatus of the exemplary embodiment.

FIG. 1 is a perspective view illustrating a liquid ejecting apparatus 1 of the exemplary embodiment. FIG. 2 is a cross-sectional view illustrating a schematic configuration of the liquid ejecting apparatus 1 of the exemplary embodiment. Note that the liquid ejecting apparatus 1 illustrated in FIGS. 1 and 2 indicates a liquid ejecting apparatus that is common in First to Sixth Exemplary Embodiments described below.

As illustrated in FIG. 1, the liquid ejecting apparatus 1 is an example of a large format printer (LFP) configured to handle an elongated sheet S being an example of a medium. The liquid ejecting apparatus 1 includes a pair of leg portions 13 with wheels 12 attached to the lower ends and a housing unit 14 assembled on the leg portions 13. Note that, in the exemplary embodiment, the direction along the direction of gravity is defined as a vertical direction Z, and the longitudinal direction of the housing unit 14 that intersects (orthogonal to, in the exemplary embodiment) the vertical direction Z is defined as a width direction X. In addition, a direction intersecting (orthogonal to, in the exemplary embodiment) both of the vertical direction Z and the width direction X is defined as a front-rear direction Y.

A feeding unit 15 configured to feed the sheet S toward the housing unit 14 side is arranged on the rear side below the housing unit 14. The sheet S of the exemplary embodiment is a roll paper. The sheet S is a transfer medium (transfer paper) for sublimation transfer textile printing in which a transfer image (mirror image) formed to leave margins at the end portions of the width direction X to be the short direction is transferred onto a transfer-target medium (for example, a fabric such as polyester). The liquid ejecting apparatus 1 of the exemplary embodiment is an ink jet-type printer configured to form a transfer image by ejecting sublimation type textile ink being an example of a liquid onto the sheet S.

A winding unit 16 supported by the leg portion 13 is arranged on the front side below the housing unit 14. Between the feeding unit 15 and the winding unit 16, a medium guide unit 17 is arranged along the transport path of the sheet S.

The rear end side of the medium guide unit 17 is accommodated in the housing unit 14 and the front end side protrudes forward from the housing unit 14. Further, an ejection port 14*a* for ejecting the sheet S from the interior of the housing unit 14 is formed, at a position on the upper side of the medium guide unit 17, on the front face side of the housing unit 14.

In the vicinity of the winding unit 16, a tension applying mechanism 18 configured to apply tension to the sheet S placed between the medium guide unit 17 and the winding unit 16 is arranged. The tension applying mechanism 18 includes a pair of arm members 19 pivotably supported at the lower portion of the leg portion 13 and a tension roller 20 rotatably supported at the edge portion portions of the pair of arm members 19. While the winding unit 16 includes a pair of holders 21 for holding, from both sides in the axial direction, a core material (not illustrated)(for example, paper tube) for winding the printed sheet S in a cylindrical shape.

In the housing unit 14, a controller 22 configured to control the overall operation of the liquid ejecting apparatus 1 is arranged. An operation panel 23 configured for performing a setting operation and an input operation is arranged on the first end side (the right end side in FIG. 1) in the width direction X on the upper portion of the housing unit 14. Note that the operation panel 23 is electrically coupled to the controller 22.

A liquid storage container 24 capable of containing ink is arranged, at the lower portion of the housing unit 14, on the first end side (the right end side in FIG. 1) which is outside of the transport path of the sheet S in the width direction X. A plurality of (four in the exemplary embodiment) liquid storage containers 24 are arranged corresponding to the types and colors of the ink.

As illustrated in FIG. 2, a roll body R1 where the sheet S onto which printing is to be performed is wound several times in a cylindrical shape, is held in the feeding unit 15. Note that the feeding unit 15 is loaded in an exchangeable manner with the roll bodies R1 having a plurality of sizes different in width of the sheet S (length in the width direction X to be the short direction) and the number of windings.

Note that the roll body R1 is to be loaded in the feeding unit 15 irrespective of its size in a state of being brought close to the first end side (right end side in FIG. 1) in the width direction X. That is, in the exemplary embodiment, the alignment reference position of the sheet S is set at the first end side in the width direction X. Then, the feeding unit 15 rotates counterclockwise the roll body R1 in FIG. 2, then, the sheet S is released from the roll body R1 and fed into the housing unit 14.

The housing unit 14 accommodates a transporting roller 25 configured to transport the sheet S, a recording unit 26 configured to perform printing (recording) on the sheet S being transported in the transport direction F by the transporting roller 25, a medium supporting unit 27 configured to support the sheet S, and a suction mechanism 28 configured to suck the sheet S. The transporting roller 25 is composed of a main roller 251 and a sub roller 252 (see FIG. 4).

The recording unit 26 is arranged with guide shafts 29 and 30 provided to extend in the width direction X, a carriage 31 supported by the guide shafts 29 and 30, and a liquid ejecting unit 32 held at the lower portion of the carriage 31. Then, the carriage 31 moves reciprocating along the guide shafts 29 and 30 in a movement region extending in the main scanning direction (the width direction X in the exemplary embodiment) orthogonal to the transport direction F of the sheet S. Note that, when the liquid ejecting unit 32 ejects an ink onto the sheet S, it suffices that the liquid ejecting unit 32 and the medium supporting unit 27 are disposed to face each other.

An adjustment mechanism 33 configured to vary the height (the position in the vertical direction Z) of the liquid ejecting unit 32 to adjust the separation distance between the liquid ejecting unit 32 and the sheet S is arranged at both ends of the guide shafts 29 and 30 in the width direction X. A reflection-type sensor 34 being a sheet width sensor is held, at the lower portion of the carriage 31, at a position on the downstream ejecting than the liquid unit 32 in the transport direction.

The reflection-type sensor 34 is an optical sensor including a light source unit and a light receiving unit (not illustrated), and is configured to cause the light receiving unit to receive the reflected light of the light emitted downward from the light source unit and to output a detected value V (voltage value) commensurating with the strength of the reflected light received by the light receiving unit to the controller 22. Further, the controller 22 causes the reflection-type sensor 34 to perform detection while moving the carriage 31 in the main scanning direction, and detects the position where the reflection target changes based on the detected value V, that is, the positions of both end portions of the sheet S in the width direction X, to thus calculate the width (length in the width direction X) of the sheet S.

Then, the liquid ejecting unit 32, in accordance with the detected width of the sheet S, ejects an ink supplied from the liquid storage container 24 onto the sheet S being transported along the transport path, to thus perform recording (printing). The printed sheet S is guided obliquely downward along the medium guide unit 17, and then wound up by the winding unit 16 to form a roll body R2. The tension roller 20 then presses the back face side of the sheet S hanging down by its own weight from the medium guide unit 17, to thus apply tension to the sheet S to be wound by the winding unit 16.

Note that the liquid ejecting apparatus 1 of the exemplary embodiment also enables the sheet S to be ejected without winding up the sheet S on the roll body R2. For example, the printed sheet S may also be accommodated in an ejection basket (not illustrated) attached in place of the winding unit 16.

First Exemplary Embodiment

Figure 3:
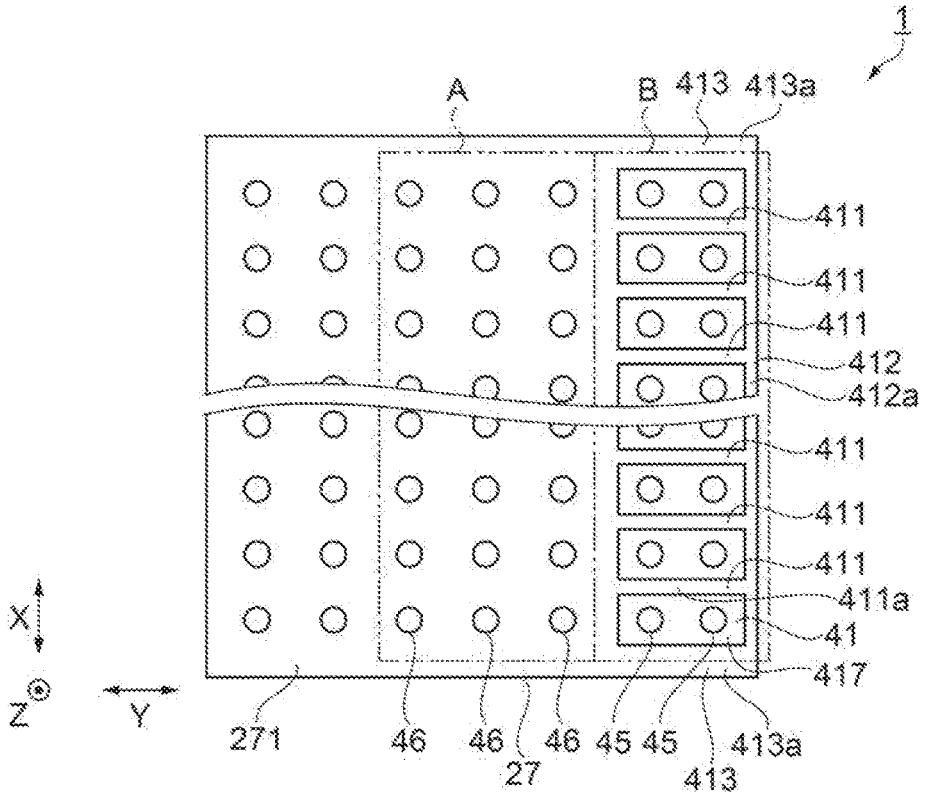
FIG. 3 is a top view illustrating a schematic configuration of a medium supporting unit of First Exemplary Embodiment.
Figure 4:
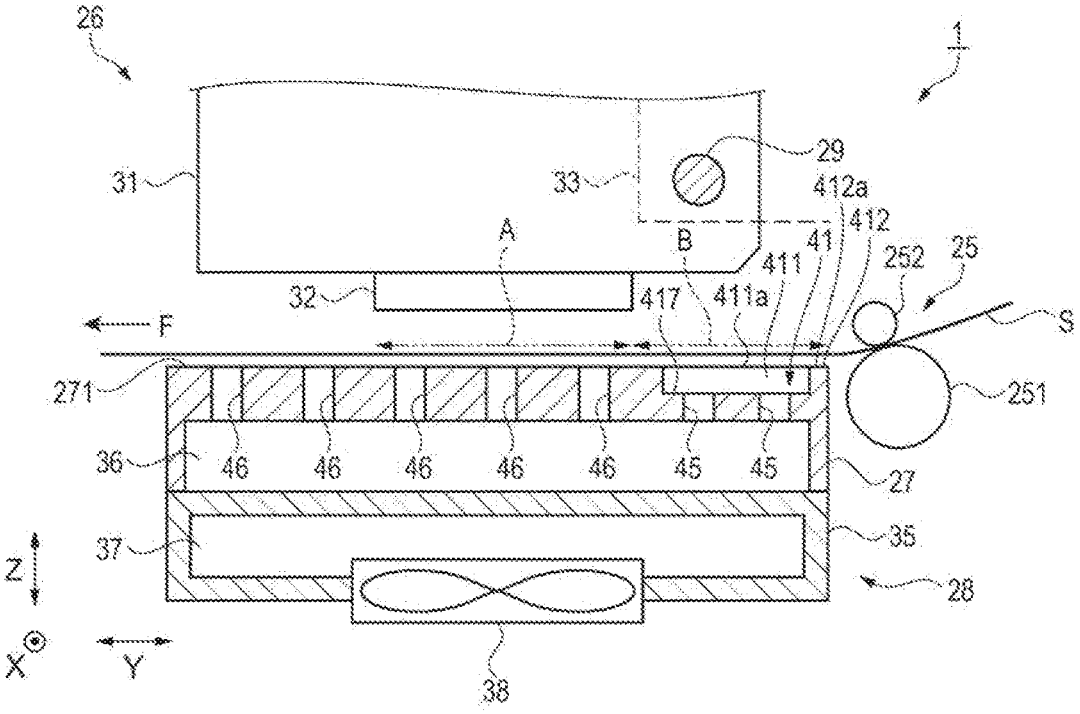
FIG. 4 is a cross-sectional view illustrating a schematic configuration of a medium supporting unit and a suction mechanism of First Exemplary Embodiment.

FIG. 3 is a top view illustrating a schematic configuration of the medium supporting unit 27 of First Exemplary Embodiment. FIG. 4 is a cross-sectional view illustrating a schematic configuration of the medium supporting unit 27 and the suction mechanism 28 of First Exemplary Embodiment. Note that FIG. 4 is a cross-sectional view illustrating a state of being cut along the transport direction F (the front-rear direction Y).

As illustrated in FIG. 4, the medium supporting unit 27 having a bottomed box shape, is fixed below the movement region of the carriage 31 such that the bottom portion is disposed on the upper side (the opening side is disposed on the lower side). In addition, a suction chamber forming member 35 having a box-like shape is arranged in the lower portion of the medium supporting unit 27. Further, a negative pressure chamber 36 is formed by the medium supporting unit 27 and the suction chamber forming member 35.

The suction chamber forming member 35 forms a suction chamber 37 communicating with the negative pressure chamber 36. An exhaust fan 38 configured to eject an air in the suction chamber 37 to the outside is arranged in the suction chamber forming member 35. Note that the suction mechanism 28 is configured by the suction chamber forming member 35 and the exhaust fan 38.

As illustrated in FIGS. 3 and 4, on the upper face side of the medium supporting unit 27, a first rib 411 in parallel with the transport direction F is formed in a region B located further upstream in the transport direction F than an eject region (print region) A where the liquid ejecting unit 32 ejects onto the sheet S. In addition, a plurality of first ribs 411 are formed in the width direction X intersecting the transport direction F. The first ribs 411 are also formed at regular intervals. Note that the eject region is the maximum region where the liquid ejecting unit can perform printing onto the medium. In First Exemplary Embodiment, the eject region A is the maximum region where the liquid ejecting unit 32 can perform printing onto the sheet S when the carriage 31 is moved without transporting the sheet S.

As illustrated in FIG. 3, in the region B, a plurality of recessed portions 41 divided by the plurality of first ribs 411 are formed in the width direction X intersecting the transport direction F. Note that the recessed portion 41 is specifically formed, being surrounded by an outer circumferential rib 412 formed across the width direction X intersecting the transport direction F at the edge portion of the medium supporting unit 27 on the upstream, an outer circumferential rib 413 formed along the transport direction F at both end portions in the width direction X, and a transport face 271 of the medium supporting unit 27. Then, a plurality of recessed portions 41 are formed by being divided by the plurality of first ribs 411. The first ribs 411 of First Exemplary Embodiment formed at equal intervals cause the plurality of recessed portions 41 to be formed at equal intervals as well.

The heights of an upper end face 411*a* of the first rib 411, upper end faces 412*a* and 413*a* of the outer circumferential ribs 412 and 413, and the transport face 271 are formed at the same height. The first rib 411, the recessed portion 41, the outer circumferential ribs 412 and 413 of First Exemplary Embodiment are formed integrally with the medium supporting unit 27.

Note that a pair of medium pressing members (not illustrated) for pressing the sheet S are arranged on the upper portion of the transport face 271, including the outer circumferential rib 413, corresponding to both end portions in the width direction X, and presses the sheet S to the outer circumferential rib 413 and the transport face 271 in the vertical direction Z. Note that while one of the medium pressing members as the reference is fixed, the other can be moved in the width direction X in accordance with the width size of the sheet S.

Respective two suction holes 45 that make the recessed portion 41 and the negative pressure chamber 36 communicate with each other are arranged on each of bottom faces 417 of the plurality of recessed portions 41. The suction hole 45 causes the suction mechanism 28 to apply a suction force onto the sheet S.

Note that on the transport face 271 of the medium supporting unit 27, including the print region A, located downstream in the transport direction F, a plurality of suction holes 46 are arranged at regular intervals in both the transport direction F (the front-rear direction Y) and the width direction X intersecting the transport direction F. The suction holes 46 cause the transport face 271 to communicate with the negative pressure chamber 36, to thus cause the suction mechanism 28 to apply a suction force onto the sheet S.

Figure 5:
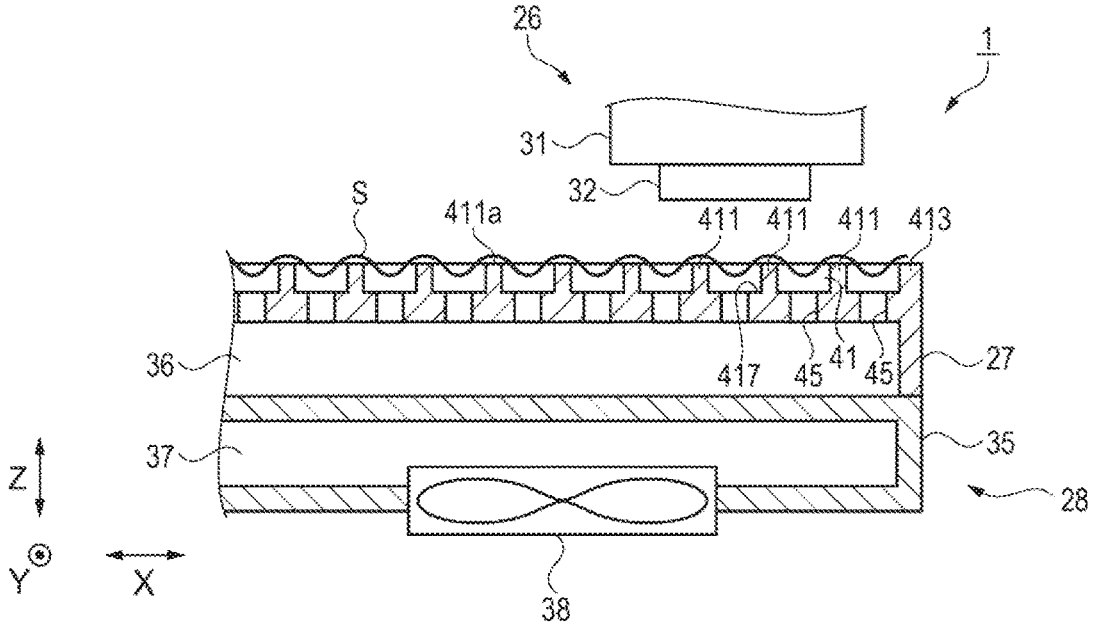
FIG. 5 is a cross-sectional view for explaining operations of a medium supporting unit and a suction mechanism of First Exemplary Embodiment.

FIG. 5 is a cross-sectional view for explaining operations of the medium supporting unit 27 and the suction mechanism 28 of First Exemplary Embodiment. Note that FIG. 5 is a cross-sectional view illustrating a state in which the region B located upstream of the print region A in the transport direction F is cut along the width direction X.

Note that when the sheet S is fed from the transporting roller 25 to the medium supporting unit 27 and then transported in the region B, the exhaust fan 38 starts driving to rotate. In the medium supporting unit 27, the suction hole 45 formed in the bottom face 417 of the recessed portion 41 communicates with the negative pressure chamber 36.

Accordingly, the pressure in the suction chamber 37 and the negative pressure chamber 36 become negative due to the rotation of the exhaust fan 38, then the negative pressure is applied to the recessed portion 41 the opening of which is covered with the sheet S. Then, the sheet S is in a state of slightly bending to form waves in the width direction X by being sucked into the recessed portions 41 while supported by the first ribs 411.

The sheet S is supported by the upper end faces 411*a* of the first ribs 411 formed parallel to the transport direction F, and is continuously transported in the direction to the print region A while being sucked into the recessed portions 41. This operation enables the sheet S to be deformed into tunnel-like form along the transport direction F, to cause so-called longitudinal wrinkles to be generated.

Then, the sheet S, in a state where longitudinal wrinkles are being generated in the region B, is transported to the print region A. The sheet S transported to the print region A is caused to be printed by the recording unit 26 (the liquid ejecting unit 32) ejecting ink. Note that the sheet S is sucked to the transport face 271 by the suction holes 46 communicating the transport face 271 with the negative pressure chamber 36 to be in a state of being transported at the medium supporting unit 27 at the print region A and the downstream of the print region A in the transport direction F. This state enables the separation distance between the liquid ejecting unit 32 and the recording surface of the sheet S to be made constant, and causes the landing of the ink droplets to be stable. Note that the printed and swollen sheet S is sucked by the transport face 271 to be properly transported downstream along the transport face 271.

Note that, even when the suction mechanism 28 does not apply the suction force onto the sheet S being transported in the region B as well, as illustrated in FIG. 5, the sheet S is transported on the upper end faces 411*a* of the plurality of first ribs 411 arranged in parallel with the transport direction F and provided in the width direction X intersecting the transport direction F. This causes a sheet S having a weak rigidity to be in a state of slightly bending to form waves in the width direction X and to be then transported while being supported by the first ribs 411. This enables longitudinal wrinkles to be generated. Note that in this case, the degree of longitudinal wrinkles is less than when the suction force is applied.

According to the liquid ejecting apparatus 1 of First Exemplary Embodiment, the following advantages can be obtained.

According to the liquid ejecting apparatus 1 of First Exemplary Embodiment, in the region B of the medium supporting unit 27 located upstream in the transport direction F than the print region A, the sheet S is to be transported on the upper end faces 411*a* of the plurality of first ribs 411 arranged in parallel with the transport direction F and provided in the width direction X intersecting the transport direction F. Then, even when the suction force is not applied, in a case of a thin sheet S which is prone to buckling, the thin sheet is in a state of slightly bending to form waves in the width direction X and is then transported while being in a state of supported by the first ribs 411. This enables longitudinal wrinkles to be generated in the transport direction F. This enables the sheet S to improve the buckling stress in the transport direction F, thus suppressing buckling of the sheet S.

As the liquid ejecting apparatus 1 of the First Exemplary Embodiment includes the recessed portion 41 and the suction hole 45, in addition to the first rib 411, the suction force of the suction mechanism 28 is applied onto the sheet S being transported in the region B, whereby longitudinal wrinkles are generated in the transport direction F further. This enables the sheet S to further improve the buckling stress in the transport direction F, further suppressing buckling of the sheet S.

Generally, the transport resistance becomes maximum at a region located upstream in the transport direction than the print region due to the transport resistance at the print region and the downstream than the print region in the transport direction, thus, buckling is liable to occur in the region located at the upstream side. In contrast, according to the liquid ejecting apparatus 1 of First Exemplary Embodiment, the first ribs 411, the recessed portions 41, and the suction holes 45 provided in the region B on the upstream are caused to form longitudinal wrinkles in the sheet S to improve the buckling stress in the region B before printing is performed, thus suppresses an occurrence of buckling of the sheet S. This significant advantage enables stable printing and transportation regarding the subsequent printing and transportation.

According to the liquid ejecting apparatus 1 of First Exemplary Embodiment, the first ribs 411 arranged at equal intervals in the width direction X to prevent the sheet S being transported from being deviated in the width direction X enables a transportation along the transport direction F.

According to the liquid ejecting apparatus 1 of First Exemplary Embodiment, the first ribs 411 form integrally with the medium supporting unit 27 to eliminate the need to arrange a separate member on the medium supporting unit 27, thus simplifying the structure to reduce the number of assembling steps.

According to the liquid ejecting apparatus 1 of First Exemplary Embodiment, in the region B, the suction force of the suction mechanism 28 regularly bends the sheet S in the width direction X along the arrangement of the recessed portions 41, thus enables the winding curl curved in the longitudinal direction by being wound into a cylindrical shape to be corrected.

Note that the disclosure is not limited to the exemplary embodiment described above, and the exemplary embodiment described above can be variously changed and modified. Such modified examples are described below.

Modified Example 1

The first ribs 411 in First Exemplary Embodiment, which are arranged at equal intervals in the width direction X, may also be arranged with a variation of intervals of approximately ±10%, where the first ribs 411 prevent the sheet S being transported from being deviated in the width direction X to enable a transportation along the transport direction F as in First Exemplary Embodiment.

Second Exemplary Embodiment

Figure 6:
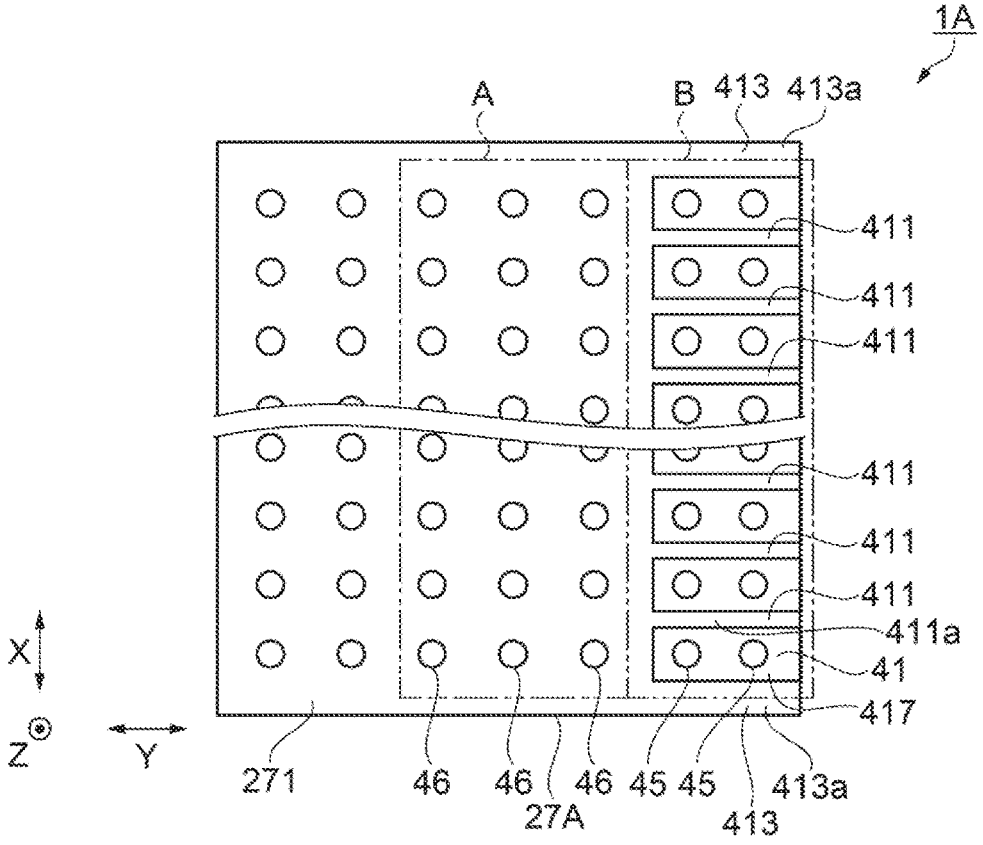
FIG. 6 is a top view illustrating a schematic configuration of a medium supporting unit of Second Exemplary Embodiment.
Figure 7:
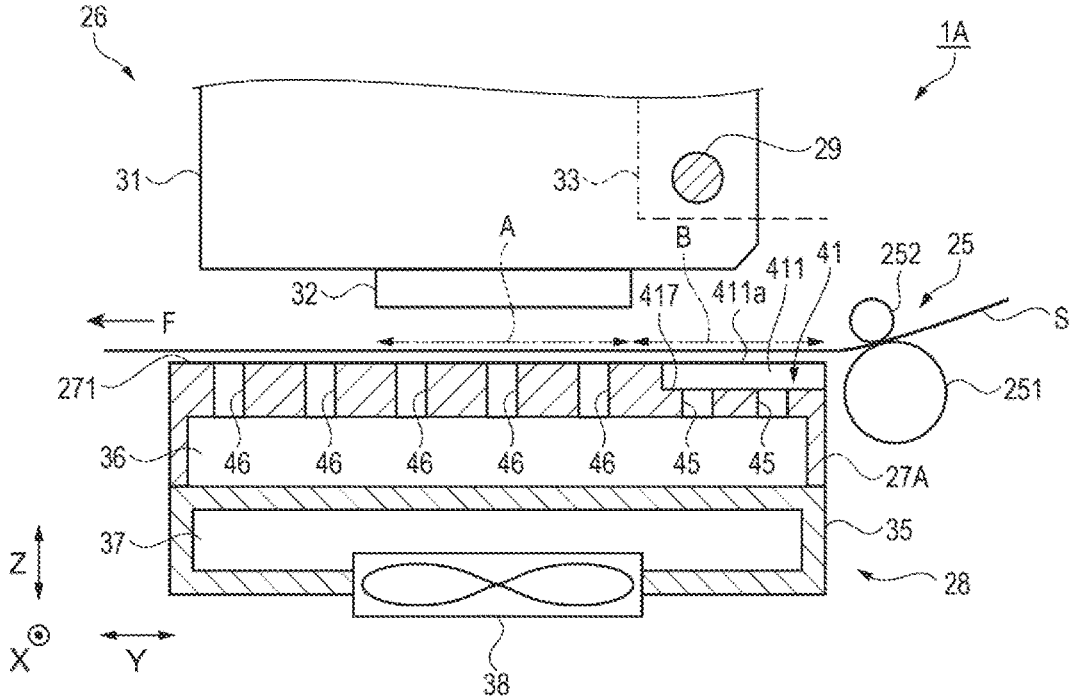
FIG. 7 is a cross-sectional view illustrating a schematic configuration of a medium supporting unit and a suction mechanism of Second Exemplary Embodiment.

FIG. 6 is a top view illustrating a schematic configuration of a medium supporting unit 27A of Second Exemplary Embodiment. FIG. 7 is a cross-sectional view illustrating a schematic configuration of the medium supporting unit 27A and the suction mechanism 28 of Second Exemplary Embodiment. Note that FIG. 7 is a cross-sectional view illustrating a state of being cut along the transport direction F (the front-rear direction Y).

With reference to FIGS. 6 and 7, a liquid ejecting apparatus 1A of Second Exemplary Embodiment will be described. Note that the configurations as in First Exemplary Embodiment are referenced using like numbers, and no detailed descriptions for such configurations are provided below.

The differences from First Exemplary Embodiment of the Second Exemplary Embodiment are described below. In First Exemplary Embodiment, the outer circumferential rib 412, which is formed across the width direction X at the end portion of the region B on the upstream side which is the edge portion of the medium supporting unit 27 on the further upstream side than the print region A in the transport direction F, is not formed in the medium supporting unit 27A of Second Exemplary Embodiment. The other configurations are the same as in the medium supporting unit 27 of First Exemplary Embodiment.

In this configuration, as illustrated in FIG. 7, when the sheet S is fed from the transporting roller 25 to the medium supporting unit 27A, the sheet S is transported on the upper end faces 411*a* of the first ribs 411 and the upper end face 413*a* of the outer circumferential rib 413.

Then, when the pressure in the suction chamber 37 and the negative pressure chamber 36 become negative due to the rotation of the exhaust fan 38, the negative pressure is applied to the inside of the recessed portion 41. The Second Exemplary Embodiment is devoid of the outer circumferential rib 412 in the First Exemplary Embodiment, thus the negative pressure (suction force) is reduced as compared to the negative pressure (suction force) in First Exemplary Embodiment, and the sheet S is sucked into the recessed portions 41 while being in a state of supported by the first ribs 411 to be in a state of slightly bending to form waves in the width direction X.

Then, the sheet S, which is supported by the upper end faces 411*a* of the first ribs 411 formed parallel to the transport direction F, is continuously transported in the direction to the print region A while being sucked into the recessed portions 41. This operation enables the sheet S to deform into tunnel-like form along the transport direction F, to cause so-called longitudinal wrinkles to be generated.

Note that subsequent operations that are the same as in First Exemplary Embodiment are omitted to be described.

According to liquid ejecting apparatus 1A of Second Exemplary Embodiment, the following advantages can be obtained.

According to the liquid ejecting apparatus 1A of Second Exemplary Embodiment, even when the outer circumferential rib 412 in First Exemplary Embodiment is not formed at the end portion at the upstream side in the region B and the suction force is not applied, when a thin sheet S is prone to buckling, the sheet is in a state of slightly bending to form waves in the width direction X and then transported while being in a state of supported by the first ribs 411. This enables longitudinal wrinkles to be generated in the transport direction F. This enables the sheet S to improve the buckling stress in the transport direction F, thus suppressing buckling of the sheet S.

According to the liquid ejecting apparatus 1A of Second Exemplary Embodiment, even when the outer circumferential rib 412 in First Exemplary Embodiment is not formed at the end portion at the upstream side in the region B, the suction mechanism 28 to apply negative pressure (suction force) as in First Exemplary Embodiment is enabled. Note that although the suction force is reduced as compared to First Exemplary Embodiment, this enables the sheet S to form longitudinal wrinkles to improve the buckling stress in the region B before printing is performed, thus suppressing an occurrence of buckling.

Third Exemplary Embodiment

Figure 8:
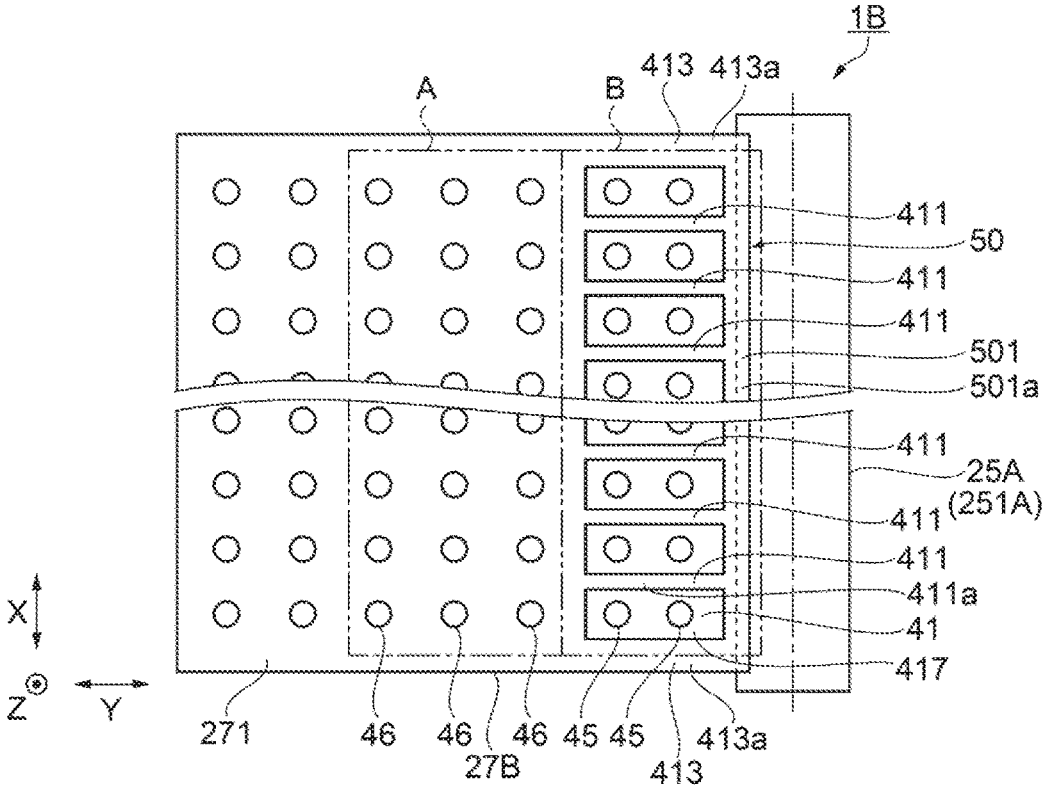
FIG. 8 is a top view illustrating a schematic configuration of a medium supporting unit and a transporting roller of Third Exemplary Embodiment.
Figure 9:
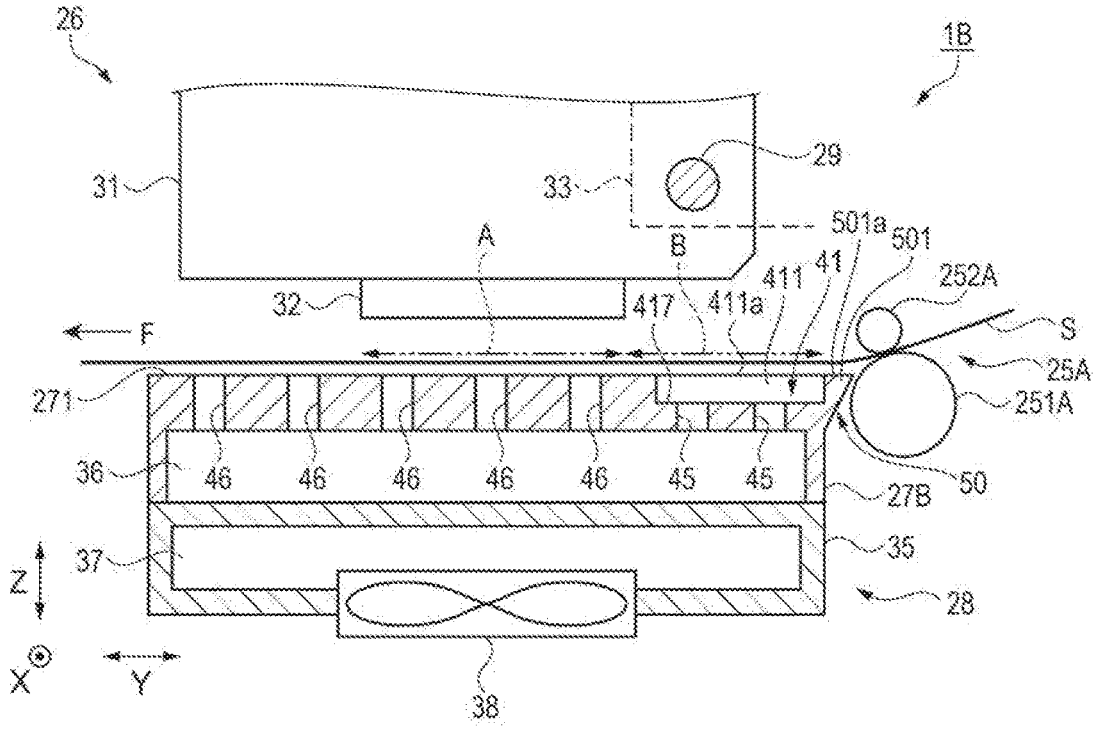
FIG. 9 is a cross-sectional view illustrating a schematic configuration of a medium supporting unit, a suction mechanism, and a transporting roller of Third Exemplary Embodiment.

FIG. 8 is a top view illustrating a schematic configuration of a medium supporting unit 27B and a transporting roller 25A of Third Exemplary Embodiment. FIG. 9 is a cross-sectional view illustrating a schematic configuration of the medium supporting unit 27B, the suction mechanism 28, and the transporting roller 25A of Third Exemplary Embodiment. Note that FIG. 9 is a cross-sectional view illustrating a state of being cut along the transport direction F (the front-rear direction Y).

With reference to FIGS. 8 and 9, a liquid ejecting apparatus 1B of Third Exemplary Embodiment will be described. Note that the configurations as in First Exemplary Embodiment are referenced using like numbers, and no detailed descriptions for such configurations are provided below.

The differences from First Exemplary Embodiment of Third Exemplary Embodiment are described below. In First Exemplary Embodiment, the end portion at the upstream side in the region B (the medium supporting unit 27) does not overlap in a plan view with the main roller 251 of the transporting roller 25 as viewed from the upward direction to the downward direction in the vertical direction Z. However, the end portion at the upstream side of the medium supporting unit 27B of Third Exemplary Embodiment overlaps with a main roller 251A of the transporting roller 25A in the same plan view.

Note that the transporting roller 25A of Third Exemplary Embodiment is configured in the same manner as in the transporting roller 25 of First Exemplary Embodiment, and is composed of the main roller 251A and a sub roller 252A.

Further, as illustrated in FIG. 9, the end portion of the medium supporting unit 27B on the upstream side of Third Exemplary Embodiment is formed as an eave portion 50 extending upward as approaching the main roller 251A to overlap in a plan view with the main roller 251A. The edge portion of the eave portion 50 includes a second rib 501 across the width direction X. Note that heights of the upper end faces 411*a*, 501*a*, and 413*a* of the first rib 411, the second rib 501, and the outer circumferential rib 413, respectively, are formed at the same height as the transport face 271. The first rib 411, the recessed portion 41, the second rib 501, and the outer circumferential rib 413 of Third Exemplary Embodiment are formed integrally with the medium supporting unit 27B.

Note that the operations in the region B that are the same as in First Exemplary Embodiment are omitted to be described.

As described above, the liquid ejecting apparatus 1B according to Third Exemplary Embodiment enables the following advantages to be obtained in addition to the advantages as in First Exemplary Embodiment.

According to the liquid ejecting apparatus 1B of Third Exemplary Embodiment, the edge portion of the medium supporting unit 27B on the upstream side includes the eave portion 50 overlapping in a plan view with the transporting roller 25A (the main roller 251A), thus narrowing the interval between the transporting roller 25A (the main roller 251A) and the medium supporting unit 27B. As such, this enables the medium supporting unit 27B to reliably support the sheet S fed from the transporting roller 25A. In addition, the eave portion 50 includes the second rib 501 to cause the suction hole 45 to reliably perform suction, enabling the sheet S to reliably generate longitudinal wrinkles, and thus suppressing an occurrence of buckling.

Fourth Exemplary Embodiment

Figure 10:
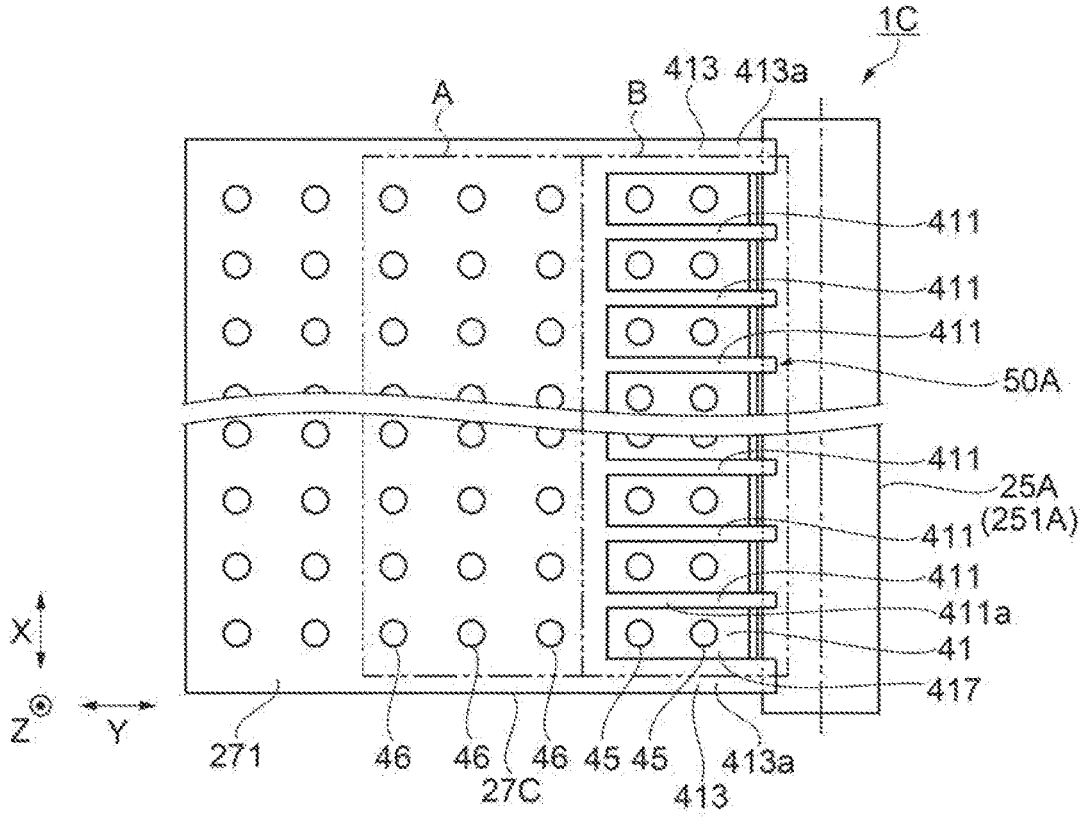
FIG. 10 is a top view illustrating a schematic configuration of a medium supporting unit and a transporting roller of Fourth Exemplary Embodiment.
Figure 11:
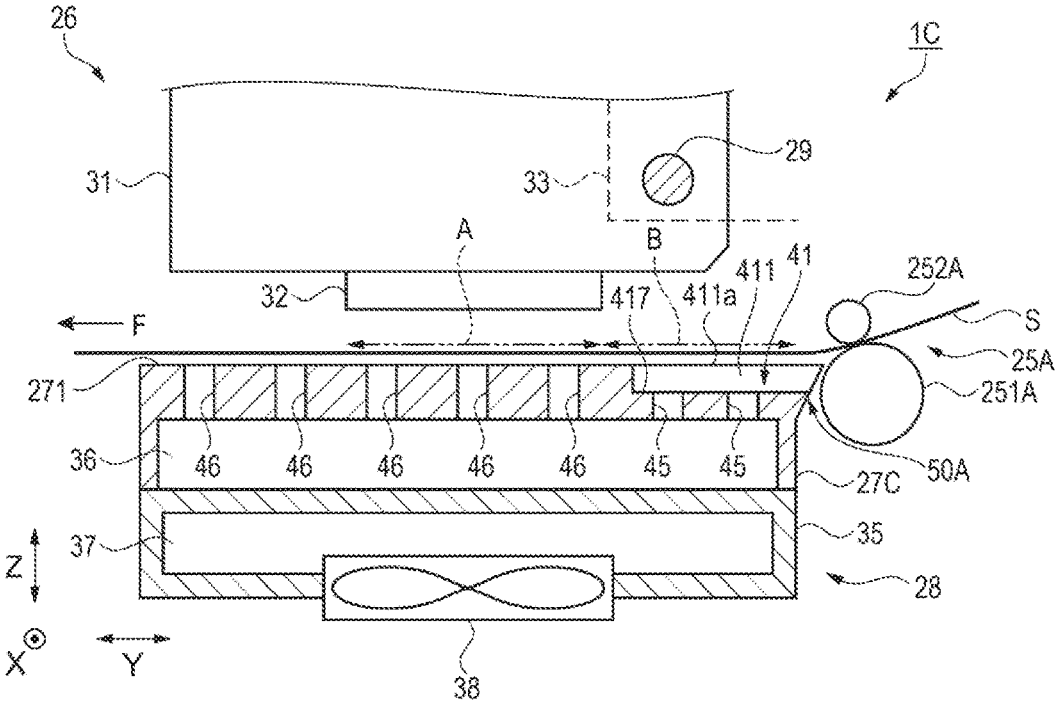
FIG. 11 is a cross-sectional view illustrating a schematic configuration of a medium supporting unit, a suction mechanism, and a transporting roller of Fourth Exemplary Embodiment.

FIG. 10 is a top view illustrating a schematic configuration of a medium supporting unit 27C and a transporting roller 25A of Fourth Exemplary Embodiment. FIG. 11 is a cross-sectional view illustrating a schematic configuration of the medium supporting unit 27C, the suction mechanism 28, and the transporting roller 25A of Fourth Exemplary Embodiment. Note that FIG. 11 is a cross-sectional view illustrating a state of being cut along the transport direction F (the front-rear direction Y).

With reference to FIGS. 10 and 11, a liquid ejecting apparatus 1C of Fourth Exemplary Embodiment will be described. Note that the configurations as in Third Exemplary Embodiment are referenced using like numbers, and no detailed descriptions for such configurations are provided below.

The differences from Third Exemplary Embodiment of Fourth Exemplary Embodiment are described below. In Third Exemplary Embodiment, the edge portion of the medium supporting unit 27B on the upstream side includes the eave portion 50 overlapping in a plan view with the transporting roller 25A (the main roller 251A). The edge portion of the eave portion 50 includes a second rib 501 across the width direction X. In Fourth Exemplary Embodiment as well, an eave portion 50A overlapping in a plan view with the transporting roller 25A (the main roller 251A) is provided. However, in Fourth Exemplary Embodiment, the second rib 501 extending in the width direction X is not formed. Alternatively, the first rib 411 extends to overlap in a plan view with the transporting roller 25A (the main roller 251A), to thus form the eave portion 50A. Similarly, the outer circumferential rib 413 that forms the both end portions in the width direction X extends to overlap in a plan view with the transporting roller 25A (the main roller 251A), to thus form the eave portion 50A.

Note that the operations in the region B that are the same as in Third Exemplary Embodiment are omitted to be described.

As described above, the liquid ejecting apparatus 1C according to Fourth Exemplary Embodiment enables the following advantages to be obtained.

According to the liquid ejecting apparatus 1C of Fourth Exemplary Embodiment, the edge portion of the medium supporting unit 27C on the upstream side includes the eave portion 50A overlapping in a plan view with the transporting roller 25A (the main roller 251A), thus narrowing the interval between the transporting roller 25A (the main roller 251A) and the medium supporting unit 27C. This enables the medium supporting unit 27C to reliably support the sheet S fed from the transporting roller 25A. This enables the sheet S to generate longitudinal wrinkles, even though the eave portion 50A does not include the second rib 501 and the suction force by the suction holes 45 is reduced as compared to the suction force in Third Exemplary Embodiment, to thus suppress an occurrence of buckling.

Fifth Exemplary Embodiment

Figure 12:
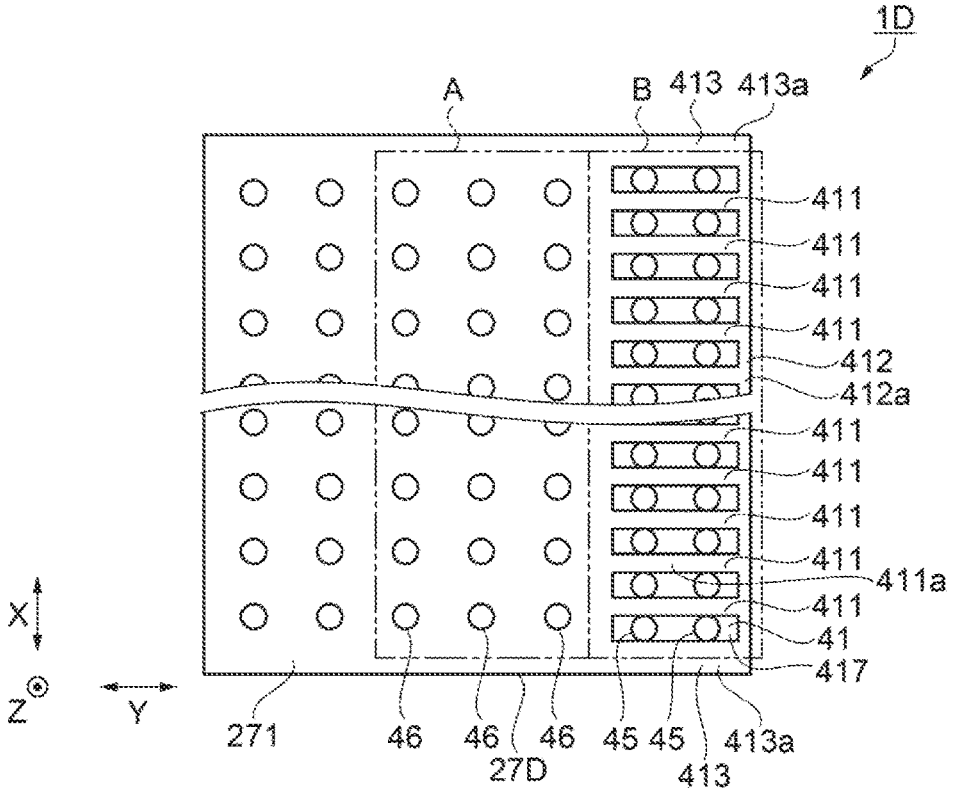
FIG. 12 is a top view illustrating a schematic configuration of a medium supporting unit of Fifth Exemplary Embodiment.

FIG. 12 is a top view illustrating a schematic configuration of a medium supporting unit 27D of Fifth Exemplary Embodiment.

With reference to FIG. 12, a liquid ejecting apparatus 1D of Fifth Exemplary Embodiment will be described. Note that the configurations as in First Exemplary Embodiment are referenced using like numbers, and no detailed descriptions for such configurations are provided below.

The differences from First Exemplary Embodiment of Fifth Exemplary Embodiment are described below. In Fifth Exemplary Embodiment, the pitch of the first ribs 411 in First Exemplary Embodiment is narrowed to form a slit-like portion between adjacent first ribs 411. In Fifth Exemplary Embodiment, the distance in the width direction X of the bottom face 417 of the recessed portion 41 is also short, and the diameter of the suction hole 45 is substantially the same as the width of the bottom face 417.

As described above, the liquid ejecting apparatus 1D according to Fifth Exemplary Embodiment enables the following advantages to be obtained in addition to the advantages as in First Exemplary Embodiment.

According to the liquid ejecting apparatus 1D of Fifth Exemplary Embodiment, it enables the pitch of the first ribs 411 that is narrower than the pitch in First Exemplary Embodiment to form a slit-like portion, thus enabling the pitch of the longitudinal wrinkles along the transport direction F of the sheet S to be narrower than the pitch in First Exemplary Embodiment, to thus increase the number of longitudinal wrinkles compared to the number in First Exemplary Embodiment. This enables the sheet S to improve the buckling stress in the transport direction F, thus suppressing buckling of the sheet S.

Sixth Exemplary Embodiment

Figure 13:
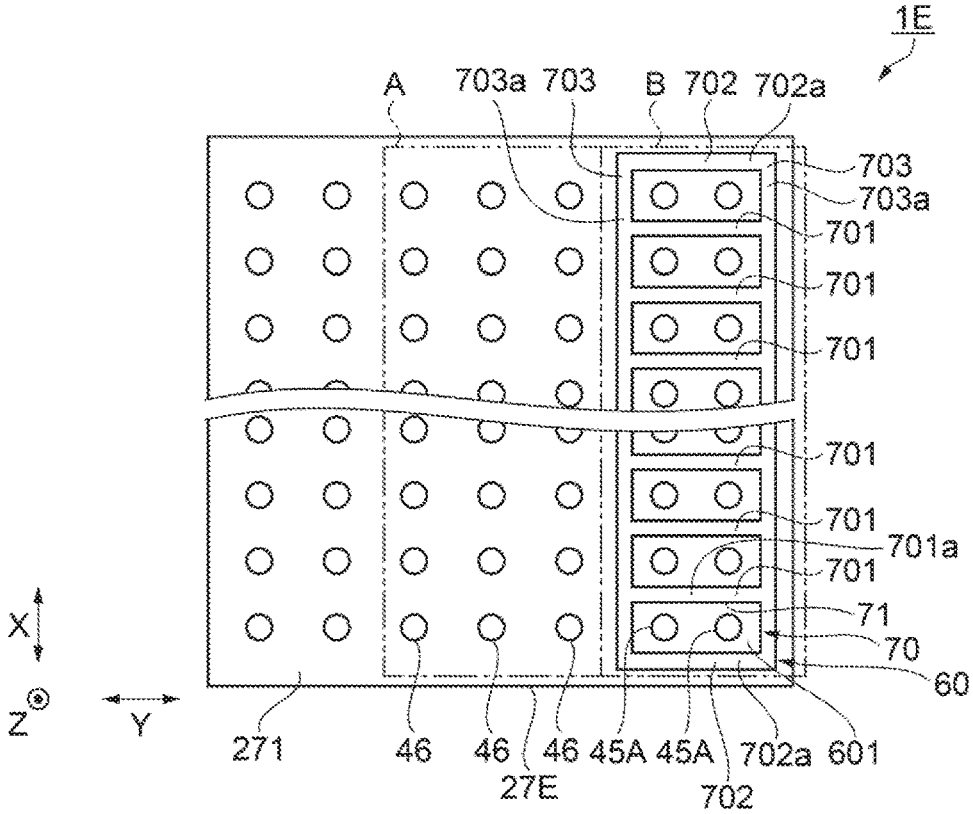
FIG. 13 is a top view illustrating a schematic configuration of a medium supporting unit and a rib configuration portion of Sixth Exemplary Embodiment.
Figure 14:
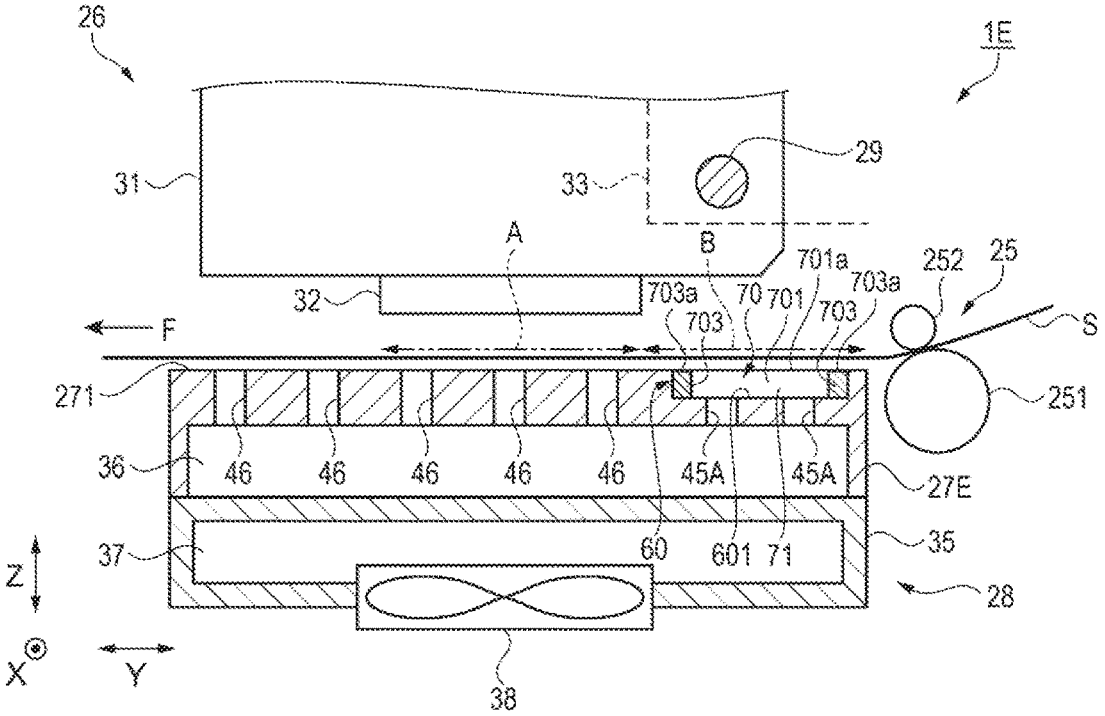
FIG. 14 is a cross-sectional view illustrating a schematic configuration of a medium supporting unit, a rib configuration portion, and a suction mechanism of Sixth Exemplary Embodiment.

FIG. 13 is a top view illustrating a schematic configuration of a medium supporting unit 27E and a rib configuration portion 70 of Sixth Exemplary Embodiment. FIG. 14 is a cross-sectional view illustrating a schematic configuration of the medium supporting unit 27E, the rib configuration portion 70, and the suction mechanism 28 of Sixth Exemplary Embodiment. Note that FIG. 14 is a cross-sectional view illustrating a state of being cut along the transport direction F (the front-rear direction Y).

With reference to FIGS. 13 and 14, a liquid ejecting apparatus 1E of Sixth Exemplary Embodiment will be described. Note that the configurations as in First Exemplary Embodiment are referenced using like numbers, and no detailed descriptions for such configurations are provided below.

The differences from First Exemplary Embodiment of Sixth Exemplary Embodiment are described below. In First Exemplary Embodiment, the first rib 411 is formed integrally with the medium supporting unit 27, while in Sixth Exemplary Embodiment, a first rib 701 that performs the same function as the first rib 411 is formed separately from the medium supporting unit 27E.

The medium supporting unit 27E of Sixth Exemplary Embodiment, is formed with a rib accommodating portion 60 being a rectangular groove in a plan view and extending in the width direction X in the region B located further upstream in the transport direction F than the print region A. In addition, the rib configuration portion 70 forms the first ribs 701. The rib configuration portion 70 is accommodated in the rib accommodating portion 60 to cause the first rib 701 to perform the same function as the first rib 411.

The rib configuration portion 70 is composed of a plate-like member having a rectangular shape. The rib configuration portion 70, when accommodated in the rib accommodating portion 60, forms a rib on the outer periphery with an outer circumferential rib 702 corresponding to both end portions in the width direction X and an outer circumferential rib 703 corresponding to the upstream side and the downstream side in the transport direction F. The ribs that divide the rectangular hole portion surrounded by the outer circumferential ribs 702 and 703 into a plurality of portions at equal pitches in the width direction X form the first ribs 701 when the rib configuration portion 70 is accommodated in the rib accommodating portion 60. In other words, the first ribs 701 are composed of a plurality of frame portions in parallel with the transport direction F. Further, a plurality of hole portions separated by the first ribs 701 are defined as hole portions 71.

When the rib configuration portion 70 is accommodated in the rib accommodating portion 60, an upper end face 701*a* of the first rib 701, an upper end face 702*a* of the outer circumferential rib 702, and an upper end face 703*a* of the outer circumferential rib 703 have the same surface height, and the transport face 271 of the medium supporting unit 27E has the same surface height as well. Respective two suction holes 45A are formed, at a portion corresponding to the center portion of the hole portion 71 of the rib configuration portion 70, on a bottom face 601 of the rib accommodating portion 60 divided by the first ribs 701.

When the sheet S is fed from the transporting roller 25 to the rib configuration portion 70 accommodated in the rib accommodating portion 60 of the medium supporting unit 27E, and is transported in the region B, the exhaust fan 38 starts driving to rotate. In the medium supporting unit 27E, the suction hole 45A formed in the bottom face 601 of the rib accommodating portion 60 communicates with the negative pressure chamber 36. The suction hole 45A further makes the negative pressure chamber 36 and the hole portion 71 communicate with each other.

Accordingly, when the pressure in the suction chamber 37 and the negative pressure chamber 36 become negative due to the rotation of the exhaust fan 38, the negative pressure is applied to the hole portion 71 covered with the sheet S. Then, the sheet S, in a state of being sucked into the hole portion 71 while being in a state of supported by the first rib 701, is in a state of slightly bending to form waves in the width direction X.

The sheet S, which is supported by the upper end faces 701*a* of the first ribs 701 formed in parallel with the transport direction F, is continuously transported in the direction of the print region A while being sucked into the hole portion 71. This operation enables the sheet S to be deformed into tunnel-like form along the transport direction F, to cause so-called longitudinal wrinkles to be generated. Then, the sheet S, in a state where longitudinal wrinkles are being generated in the region B, is transported to the print region A. The subsequent operations are the same as in First Exemplary Embodiment.

Note that, even in when the suction force is not applied, in a case of a thin sheet S which is prone to buckling, the sheet is in a state of slightly bending to form waves in the width direction X and is then transported while being in a state of supported by the first ribs 701. This enables longitudinal wrinkles to be generated in the transport direction F.

As described above, the liquid ejecting apparatus 1E according to Sixth Exemplary Embodiment enables the following advantages to be obtained in addition to the advantages as in First Exemplary Embodiment.

According to the liquid ejecting apparatus 1E of Sixth Exemplary Embodiment, the medium supporting unit 27E and the first ribs 701 (the rib configuration portion 70) to be formed as separate bodies (separate members) is caused, thus, it suffices to replace the rib configuration portion 70 when a malfunction occurs in the first ribs 701, which facilitates maintenance. The first rib 701 is composed of a frame portion having a plate shape dividing a rectangular hole portion formed in the width direction X into a plurality of hole portions 71, the frame portion being in parallel with the transport direction F when arranged on the medium supporting unit 27E. As such, even when the first rib 701 is formed separately, it can be formed easily.

Contents derived from the exemplary embodiments will be described below.

A liquid ejecting apparatus includes a liquid ejecting unit configured to eject a liquid onto a medium being transported in a transport direction, and a medium supporting unit arranged to face the liquid ejecting unit and configured to support the medium being transported, wherein the medium supporting unit includes, in a width direction intersecting the transport direction, a plurality of first ribs arranged in parallel with the transport direction at an upstream side of a region, where the liquid ejecting unit performs ejection onto the medium, in the transport direction.

According to this configuration, the medium is arranged parallel with the transport direction in the region of the medium supporting unit located further upstream in the transport direction than the eject region, and is transported on the upper end faces of the plurality of first ribs arranged in the width direction intersecting the transport direction. As such, when a thin medium which is prone to buckling, this medium is to be in a state of slightly bending to form waves in the width direction and to be then transported while being in a state of supported by the first ribs. This enables longitudinal wrinkles to be generated in the transport direction of the medium. This enables the medium to improve the buckling stress in the transport direction of the medium, thus suppressing buckling of the medium.

The liquid ejecting apparatus described above may include a suction mechanism configured to suck the medium, wherein the medium supporting unit includes, at the upstream side, a recessed portion sectioned by the first ribs, and the recessed portion includes a suction hole for causing a suction force the suction mechanism to be applied to the medium.

This configuration enables the recessed portion and the suction hole included in addition to the first rib to apply the suction force of the suction mechanism onto the medium being transported in the region on the upstream side than the eject region in the transport direction, to further cause longitudinal wrinkles to be generated in the transport direction. This enables the medium to further improve the buckling stress in the transport direction of the medium, thus further suppressing buckling of the medium.

The liquid ejecting apparatus described above may include a transporting roller configured to feed the medium to the medium supporting unit, wherein an edge portion upstream of the medium supporting unit includes an eave portion overlapping the transporting roller in a plan view, and an edge portion of the eave portion includes a second rib in the width direction.

This configuration enables the edge portion of the medium supporting unit on the upstream side to include the eave portion overlapping in a plan view with the transporting roller, thus narrowing the interval between the transporting roller and the medium supporting unit. This enables the medium supporting unit to reliably support the medium fed from the transporting roller. In addition, the eave portion includes the second rib to cause the suction hole to reliably perform suction, enabling longitudinal wrinkles to be reliably generated on the medium, to thus suppress an occurrence of buckling.

In the liquid ejecting apparatus described above, the first ribs may be arranged at equal intervals.

According to this configuration, the first ribs arranged at equal intervals in the width direction to prevent the medium being transported from being deviated in the width direction enables a transportation along the transport direction.

In the liquid ejecting apparatus described above, the first ribs may be formed integrally with or separately from the medium supporting unit.

According to this configuration eliminates, when the first ribs, for example, are formed (configured) integrally with the medium supporting unit, the need to arrange a separate member on the medium supporting unit, thus simplifying the structure to reduce the number of assembling steps. Alternatively, when the first rib is formed separately from the medium supporting unit, it suffices to replace a member configuring the first ribs when a malfunction occurs in the first ribs, which facilitates maintenance.

In the liquid ejecting apparatus described above, a slit may be formed between first ribs, which are adjacent to each other.

This configuration enables the pitch of the first ribs formed in a slit-like portion to narrow the pitch of the longitudinal wrinkles along the transport direction of the medium, thus increasing the number of longitudinal wrinkles. This enables the medium to improve the buckling stress in the transport direction of the medium, thus suppressing buckling of the medium.

In the liquid ejecting apparatus described above, when the first ribs are formed separately from the medium supporting unit, the first ribs may be composed of a frame portion having a plate shape and sectioning a rectangular hole portion formed in the width direction, the frame portion being in parallel with the transport direction when arranged on the medium supporting unit.

This configuration enables the first rib composed of a frame portion having a plate shape dividing a rectangular hole portion formed in the width direction, the frame portion being in parallel with the transport direction when arranged on the medium supporting unit to be easily formed even when formed separately as well.

What is claimed is:

1. A liquid ejecting apparatus comprising:

a liquid ejecting unit configured to eject a liquid onto a medium being transported in a transport direction;

a medium supporting unit arranged to face the liquid ejecting unit and configured to support the medium being transported;

a suction mechanism configured to suck the medium; and a transporting roller configured to feed the medium to the medium supporting unit, wherein the medium supporting unit includes, in a width direction intersecting the transport direction, a plurality of first ribs arranged in parallel with the transport direction at an upstream side of a region, where the liquid ejecting unit performs ejection onto the medium, in the transport direction;

wherein the medium supporting unit includes, at the upstream side, a recessed portion sectioned by the first ribs, wherein the recessed portion includes a suction hole for causing a suction force by the suction mechanism to be applied to the medium, wherein an edge portion at the upstream side of the medium supporting unit includes an eave portion overlapping the transporting roller in a plan view, and wherein an edge portion of the eave portion includes a plurality of second ribs arranged in the width direction, and wherein the height of the plurality of first ribs and the height of the plurality of second ribs are substantially the same.

2. The liquid ejecting apparatus according to claim 1, wherein the first ribs are arranged at equal intervals.

3. The liquid ejecting apparatus according to claim 1, wherein the first ribs are formed integrally with or separately from the medium supporting unit.

4. The liquid ejecting apparatus according to claim 3, wherein when the first ribs are formed separately from the medium supporting unit, the first ribs are composed of a frame portion having a plate shape and sectioning a rectangular hole portion formed in the width direction, the frame portion being in parallel with the transport direction when arranged on the medium supporting unit.

5. The liquid ejecting apparatus according to claim 1, wherein a slit is formed between the first ribs, which are adjacent to each other.

* * * * *